US008082713B2

(12) United States Patent
Matthews

(10) Patent No.: US 8,082,713 B2
(45) Date of Patent: Dec. 27, 2011

(54) WEEP SCREED CORNER

(76) Inventor: James F. Matthews, Fallbrook, CA (US)

( * ) Notice: Subject to any disclaimer, the term of this patent is extended or adjusted under 35 U.S.C. 154(b) by 126 days.

(21) Appl. No.: 12/289,835

(22) Filed: Nov. 5, 2008

(65) Prior Publication Data

US 2011/0120025 A1 May 26, 2011

Related U.S. Application Data

(60) Provisional application No. 60/996,162, filed on Nov. 5, 2007.

(51) Int. Cl.
*E04B 1/35* (2006.01)

(52) U.S. Cl. ..... 52/371; 52/273; 52/257; 52/364; 52/365

(58) Field of Classification Search ..... 52/273, 52/255, 256, 257, 281, 254, 272, 287.1, 288.1, 52/364, 371, 372, 375, 365, 367, 60; D25/102
See application file for complete search history.

(56) References Cited

U.S. PATENT DOCUMENTS

| | | | | | |
|---|---|---|---|---|---|
| 1,624,121 | A | * | 4/1927 | Thiem | 52/371 |
| 1,753,596 | A | * | 4/1930 | Bowman | 52/255 |
| 2,069,289 | A | * | 2/1937 | Swendsen et al. | 52/288.1 |
| 2,307,338 | A | * | 1/1943 | Sluyter et al. | 52/288.1 |
| 3,942,295 | A | * | 3/1976 | Schacht | 52/287.1 |
| 4,603,517 | A | * | 8/1986 | Lyons, Jr. | 52/60 |
| D377,598 | S | * | 1/1997 | Beard, Jr. | D8/354 |
| 5,605,019 | A | * | 2/1997 | Maziekien et al. | 52/58 |
| 5,630,297 | A | * | 5/1997 | Rutherford | 52/58 |
| 5,706,610 | A | * | 1/1998 | Mayle | 52/60 |
| 5,761,866 | A | * | 6/1998 | Maylon | 52/366 |
| D402,879 | S | * | 12/1998 | Beard, Jr. | D8/354 |
| 5,983,592 | A | * | 11/1999 | Mayle | 52/746.11 |
| 6,216,407 | B1 | * | 4/2001 | LeBlanc | 52/287.1 |
| 6,385,932 | B1 | * | 5/2002 | Melchiori | 52/302.3 |
| 6,591,559 | B2 | * | 7/2003 | Contreras et al. | 52/101 |
| D487,520 | S | * | 3/2004 | Hein et al. | D25/102 |
| D549,841 | S | * | 8/2007 | Beard, Jr. | D25/102 |
| D549,845 | S | * | 8/2007 | Beard, Jr. | D25/102 |
| D549,846 | S | * | 8/2007 | Beard, Jr. | D25/102 |
| D575,412 | S | * | 8/2008 | Beard, Jr. | D25/102 |
| D581,060 | S | * | 11/2008 | Beard, Jr. | D25/102 |
| 7,546,719 | B1 | * | 6/2009 | Guevara | 52/716.2 |
| 7,703,249 | B2 | * | 4/2010 | Rachak | 52/288.1 |
| 2005/0055914 | A1 | * | 3/2005 | Gilstrap | 52/272 |
| 2006/0254169 | A1 | * | 11/2006 | McFadden | 52/344 |
| 2007/0062137 | A1 | * | 3/2007 | Maylon | 52/367 |
| 2007/0130861 | A1 | * | 6/2007 | Chenier et al. | 52/371 |
| 2008/0245006 | A1 | * | 10/2008 | Rachak | 52/287.1 |
| 2010/0218444 | A1 | * | 9/2010 | Wambaugh et al. | 52/255 |

* cited by examiner

*Primary Examiner* — Robert Canfield
*Assistant Examiner* — Matthew Gitlin
(74) *Attorney, Agent, or Firm* — Continuum Law; Robert P. Cogan

(57) ABSTRACT

A screed corner comprises a screed base including substantially perpendicular nailing flanges and a bead leg extending away from each nailing flange. The bead has a horizontally disposed V-shaped cross section. A separate screed corner component is provided to be secured to arms of the bead and to close a gap in the screed base which is located in a volume comprising an intersection of a projection of each bead leg. The screed corner may be provided in a contour in sheet metal which can be readily bent to form a screed base. The screed corner component may comprise formed sheet metal. The corner component may comprise a sharp corner or may comprise a radius at its periphery. In one further form, the bead may comprise a substantially planar surface extending away from the nailing flange. In another, further form, the screed corner may be molded.

13 Claims, 7 Drawing Sheets

WEEP SCREED CORNER

CROSS-REFERENCE TO RELATED APPLICATIONS

The present application claims priority of provisional application Ser. No. 60/996,162 filed on Nov. 5, 2007, which is incorporated by reference herein in its entirety.

BACKGROUND OF THE INVENTION

1. Field of the Invention

The present subject matter relates to screed joints which facilitate the application of stucco, plaster, or similar materials to building walls, and, more particularly, to base screed corners.

2. Related Art

In one form of construction, plaster, cement, and stucco are used as the exterior wall materials for residential and commercial buildings. These materials allow an architect to provide a variety of different designs and wall textures. Additionally, these materials may not require periodic painting. One application technique for applying stucco comprises attaching lath material to a wall frame constructed from wood or metal studs. The lath material serves to stabilize stucco while it is in its flowable state prior to drying. Similar approaches are also commonly employed when the underlying structure is fabricated from, for example, concrete or concrete blocks. The lath material is applied to an exterior wall. Stucco is applied to the lath.

In the past, trim members known as weep screeds have been developed for use in connection with the application of stucco, plaster, or similar materials to exterior framed walls. Such trim members are commonly attached to the base of an exterior framed wall, and are strategically positioned to overlap the joint between the exterior framed wall and a foundation. The weep screeds serve to provide support for the stucco or plaster coating that is applied to the exterior framed wall and also facilitate drainage for water between the exterior framed wall and the underlying foundation. These trim members commonly have a nailing flange, which is a vertically extending attachment member for securing the weep screed to a lower portion of a wall. A bead, i.e., an outwardly protruding flange, angles downwardly from the bottom of the vertical attachment member. A lower arm of the outwardly protruding flange bends downwardly and rearwardly toward the foundation. A vertically downwardly extending lip is commonly formed on the end of the flange.

Water that contacts the exterior coating surface may be absorbed into the surface and into the building layers beneath the exterior coating surface. When weep screeds are employed, the water drains down and weeps from the structure along the edges of the weep screed. Weep screeds are generally intended to reduce moisture penetration into the wall cavity, particularly in areas where water is permitted to accumulate where the upper and lower walls join together.

The weep screeds extend along the width of adjacent perpendicular walls. A corner at the intersection of the walls must also be protected from moisture and must also support stucco. Weep screed material is commonly supplied in straight, elongated pieces. Due to the above-described construction, a length of weep screed cannot simply be bent around a corner. The prevalent technique for providing screed corners requires artisans constructing walls to fashion individual corner pieces by hand. This requirement adds significantly to the cost of producing a stucco-covered wall. The labor intensity also contributes to decreased reliability. Shoddy construction practices may result where there is a shortage of experienced artisans. Homeowners will be faced with construction defects. Builders will incur expense in performing remedial work.

Even when hand formed corners are made properly, unless executed with a degree of precision that is not generally practical to achieve on the jobsite, problems will still arise. Imperfect mating of adjoining screed edges leaves gaps in the corner joint. Small gaps allow entry of moisture through the corner into the overlying stucco. A stucco corner may lose its integrity and begin to deteriorate. Larger gaps allow the passage of insects, such as termites, or even mice.

Imprecision in forming the joint may reduce the depth of the screed at the corner. Therefore, because the screed is a template for stucco thickness, a corner that is thinner than called for in specifications may be provided. In representative situations, a corner having a thickness of ½ inch rather than ⅞ inch has been provided. This provides for a weaker corner. Additionally, the corner serves as a guide for a corner molding. The corner molding may be, for example, an extended bead, e.g., eight feet, that is applied at the corner of adjoining walls. An example of such a molding is sold under the trademark Corner Rite. The corner molding is generally plumbed to the screed corner. If the screed corner depth is inadequate, a deficient depth is provided on the entire corner molding.

Inadequately formed corners are generally not detectable by building inspectors. Typically, localities have building codes that call for an inspection after lath is applied to walls and another inspection after stucco is applied. A separate inspection is not made after screed corners are formed. Consequently, building inspections will not detect poorly made screed corners. Undetected poorly made corners have drawbacks in addition to structural problems. Over the years many people have been injured, some severely, when sheet metal base screed became exposed.

Even when corners are made with a degree of care, they are subject to degradation. During construction, compressed air lines and water hoses employed on a job site can destroy the handmade corners by snagging the base corners. After construction is completed, homeowners' water hoses and the like may wear away stucco. Once a corner is exposed, hoses may snag the screed corners and create jagged sharp edges that protrude form the corners.

SUMMARY OF THE SPECIFICATION

In accordance with embodiments of the present subject matter, there is provided a screed joint corner. The screed corner comprises a screed base including substantially perpendicular nailing flanges and a bead leg extending away from each nailing flange. The bead has a horizontally disposed V-shaped cross section. A separate screed corner component is provided to be secured to arms of the bead and to close a gap in the screed base which is located in a volume comprising an intersection of a projection of each bead leg. The screed corner may be provided in a contour in sheet metals which can be readily bent to form a screed base. The screed corner component may comprise formed sheet metal.

The corner component may comprise a sharp corner or may comprise a radius at its periphery. In one further form, the bead may comprise a substantially planar surface extending away from the nailing flange. In another, further form, the screed corner may be molded.

BRIEF DESCRIPTION OF THE DRAWINGS

Embodiments are more particularly described with reference to the following drawings taken in connection with the following description.

DETAILED DESCRIPTION

Figure 1:
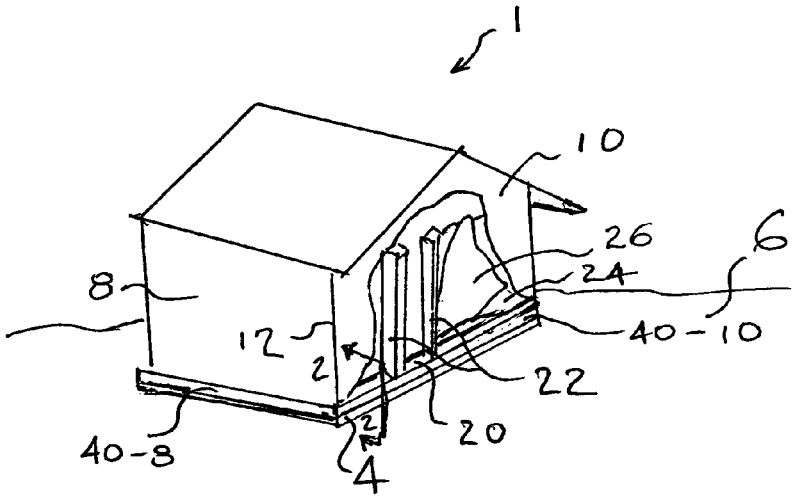
FIG. 1 is a perspective view, partially broken away, of a portion of a structure finished in stucco which may incorporate an embodiment of the present subject matter.

FIG. 1 is an illustration of a structure 1, which could, for example, comprise a house, office building, or public structure. The structure 1 is built on a slab 4. The slab 4, also known as a foundation, rests on a lot surface 6. The lot surface 6 may be a graded or paved surface. The structure 1 includes first and second walls 8 and 10 which are joined at a corner 12. In FIG. 1, the wall 10 is partially broken away to illustrate components of the wall 10. These components are described with respect to FIG. 2.

Figure 2:
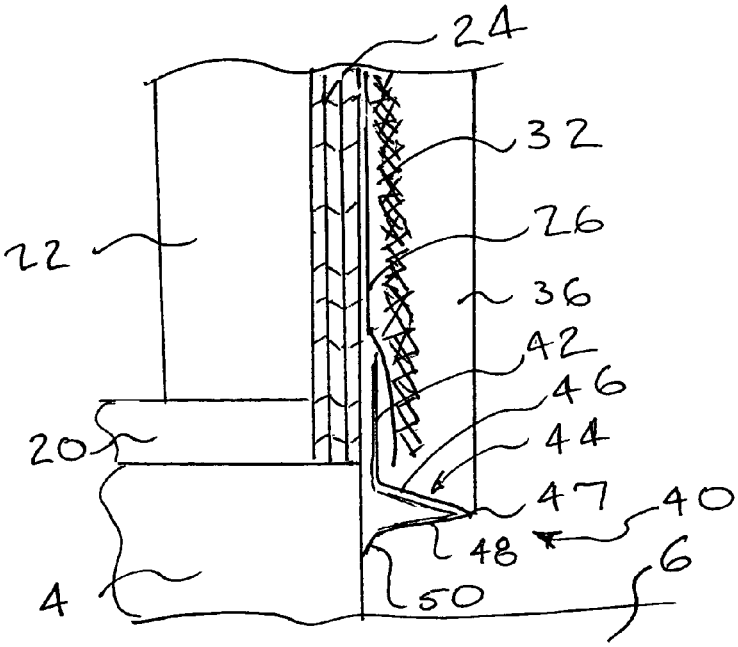
FIG. 2 is a cross-sectional view taken along line 2-2 of FIG. 1 illustrating a weep screed installation detail.

FIG. 2 is a cross-sectional view of a foundation weep screed installation taken along the lines 2-2 of FIG. 1. The structural framework of structure 1 comprises components which support the walls 6 and 8 to the slab 4. A sill plate 20 is horizontally disposed on the slab 4. The present illustration is discussed in the context of wood frame construction. However, embodiments of the present invention are not limited to use with wood frame construction. Vertically disposed studs 22 are spaced at successive positions, each being secured to the sill plate 20. Each of the walls 8 and 10 comprise sheeting 24 secured to the studs 22. A non-limiting example of sheeting 24 is plywood sheeting. The plywood sheeting 24 is covered by building paper 26. The building paper 26 wicks moisture from components which it contacts. Water is conducted away from the walls 8 and 10, and drains to the lot surface 6.

Metal lath 32 is secured over the building paper 26 to provide a base to which stucco 36 may be secured. A foundation weep screed 40 is placed along the length of a lower portion of each of the walls 8 and 10. The foundation weep screed 40 fixed to the wall 8 is denoted 40-8 (FIG. 1), and the foundation weep screed 40 fixed in the wall 10 is denoted 40-10. Each foundation weep screed 40 protects stop edges of stucco 36 and exterior insulated finish system materials at the sill plate 20. The foundation weep screed 40 comprises a vertical nailing flange 42. The vertical nailing flange 42 comprises a substantially planar, rectangular component preferably positioned so that a lower end thereof terminates at or below the bottom of the sill plate 20.

An angular bead 44 is at the lower end of the vertical nailing flange 42. The angular bead 44 includes a first arm 46 and a second arm 48 defining a horizontally disposed V-shaped cross section. The first arm 46 projects transversely away from the vertical nailing flange 42 to a corner 47. In one illustrative embodiment, the first arm 46 may form an outer angle, i.e. on the side of the weep screed 40 away from a wall 8 or 10, of 135° with the vertical nailing flange 42. The second arm 48 may form an inner angle of 45° with the first arm 46 and extend transversely toward the wall 8 or 10. A lower flange 50 extends downwardly from the angular bead 44. The foundation weep screed 40-8 and the foundation weep screed 40-10 each terminate adjacent the corner 12 (FIG. 1). A corner member must be provided in order to provide a water barrier to protect a corner 12. Prefabricated corner members have not been readily available. The prevalent practice among construction workers is to engage in a significant amount of custom handwork to fashion new corner members.

Figure 3:
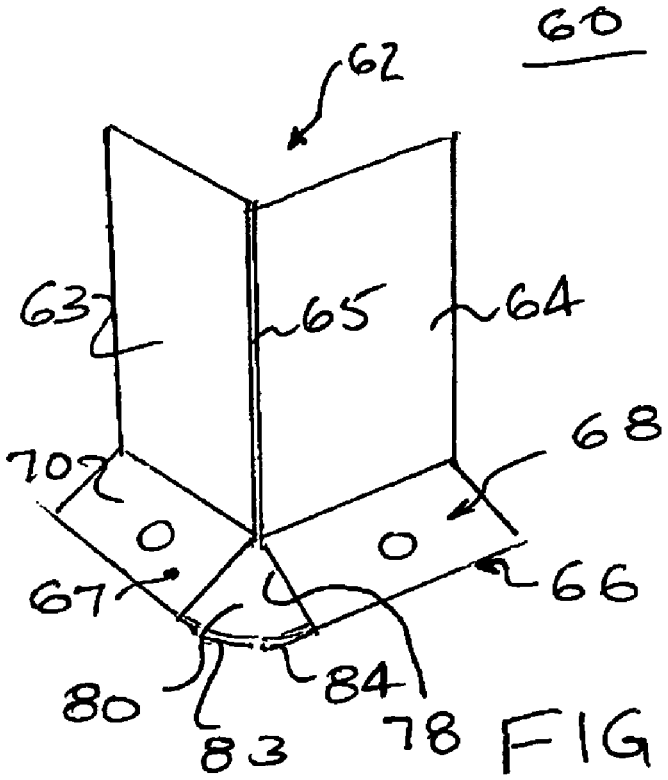
FIG. 3 is a front perspective view of the screed corner.
Figure 4:
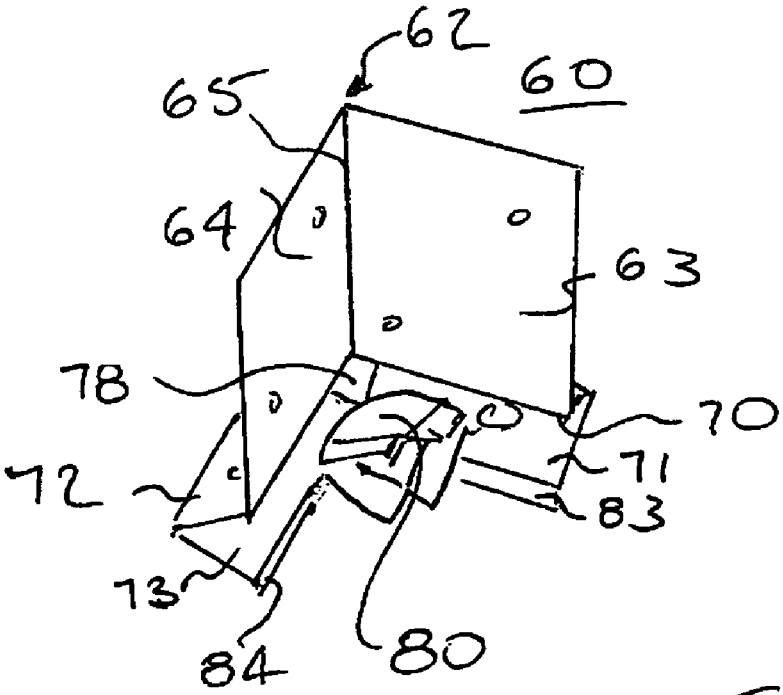
FIG. 4 is a rear perspective exploded view of the embodiment illustrated in FIG. 3.
Figure 5:
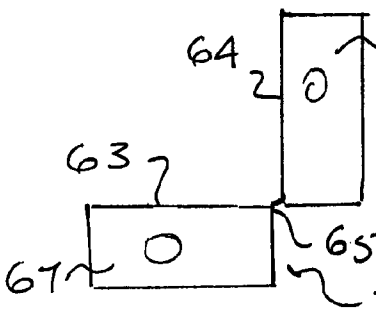
FIGS. 5 and 6 are respectively a plan view and an elevation of the embodiment.
Figure 6:
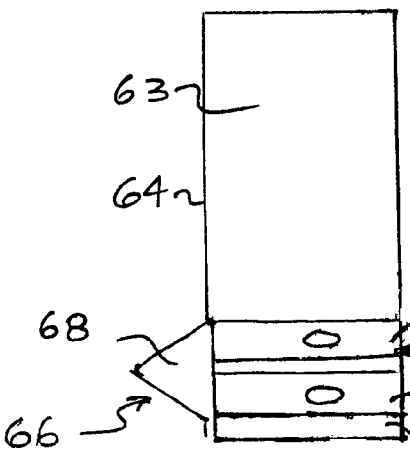
Figure 7:
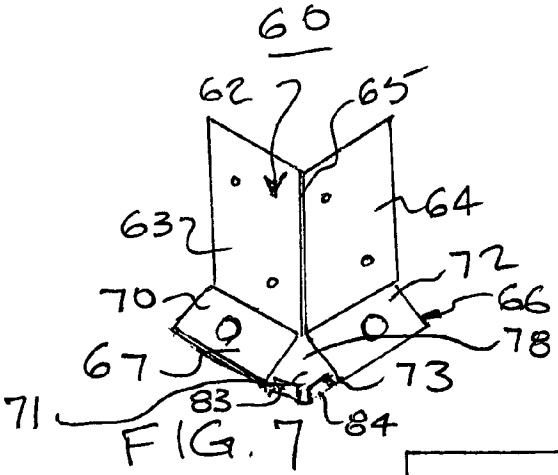
FIG. 7 is a perspective view of the screed corner base.
Figure 8:
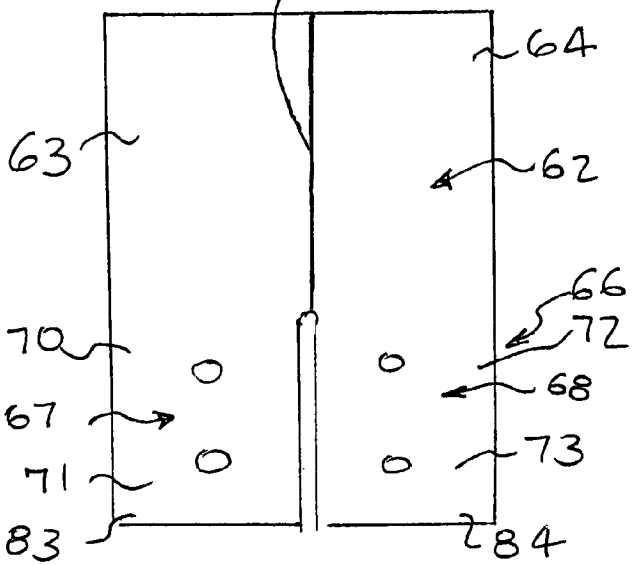
FIG. 8 is an elevation of unformed sheet metal from which a screed corner base may be formed.

In accordance with embodiments of the present subject matter, fabricated screed corners are provided. FIG. 3 is a front perspective view of a screed corner 60 constructed in accordance with an embodiment of the present subject matter. FIG. 4 is a rear perspective exploded view of the embodiment illustrated in FIG. 3. The component's discussed with respect to FIGS. 3 and 4 are further illustrated in FIGS. 5-8. FIGS. 5 and 6 are respectively a plan view and an elevation of the screed corner 60; FIG. 7 is a perspective view of the screed corner 60, and FIG. 8 is an elevation of unformed sheet metal from which the screed corner 60 is formed. The screed corner 60 comprises a vertical nailing flange 62 having first and second flange legs 63 and 64 meeting at a vertical corner 65. In the present illustration, the first flange leg 63 is secured to the wall 8 (FIG. 5), and the second flange leg 64 is secured to the wall 10. The screed corner 60 further comprises an angular corner bead 66 located below the vertical nailing flange 62. The angular corner bead 66 comprises first and second bead legs 67 and 68. The first bead leg 67 comprises upper and lower arms 70 and 71 (FIG. 4). The second bead leg 68 comprises upper and lower arms 72 and 73. The first and second bead leg 67 and 68 each comprise a horizontally disposed V-shaped projection. Lower flanges 83 and 84 extend downwardly from the lower arms 71 and 72 respectively.

In the present embodiment, the first and second angular corner beads 67 and 68 have widths equal to the widths of the first and second flange legs 63 and 64 respectively. The V-shaped projections extend away from the flange legs 63 and 64. Therefore, a gap 78 will result at the portion of the angular corner bead 66 in registration with the flange corner 65. In accordance with embodiments of the subject matter, a corner leg 80 is assembled to the screed corner 62 to close the gap 78. The corner leg 80 is illustrated in FIGS. 3 and 4, but does not form part of FIGS. 5-8. The corner leg 80 is illustrated in a state in which it is secured to the screed corner 60. The corner leg 80 may be secured by spot welding, for example, or by other forms of fastening or adhesion. In FIG. 4, the corner leg 80 is illustrated transversely displaced from the screed corner 60.

Figure 9:
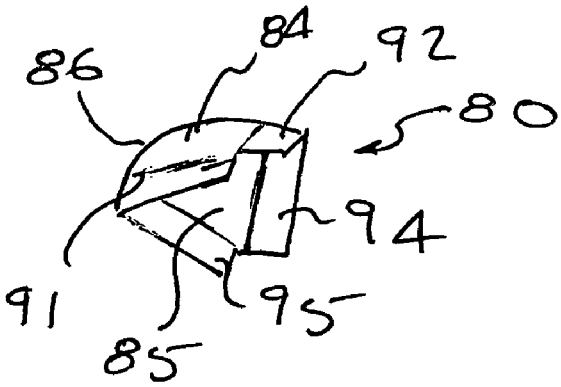
FIG. 9 is a rear perspective illustration of a first form of a screed corner leg.
Figure 10:
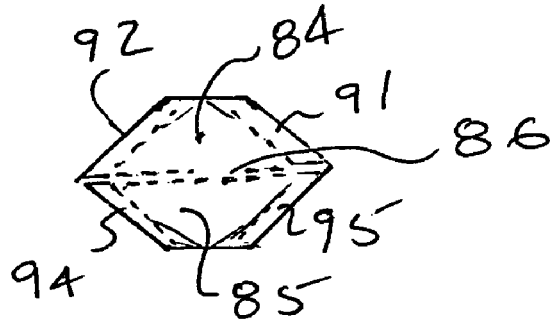
FIGS. 10 and 11 are respectively an elevation and a plan view of the screed corner leg.
Figure 11:
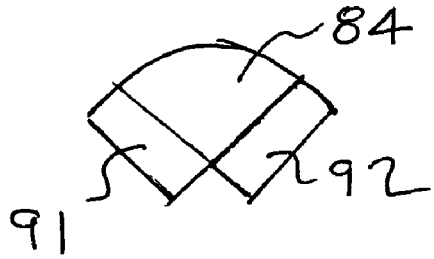
Figure 12:
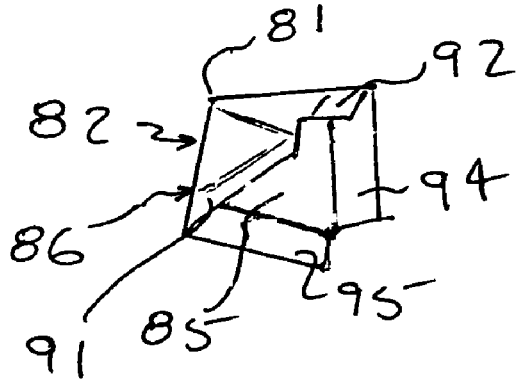
FIG. 12 is a rear perspective illustration of a second form side elevation of the screed corner leg.

The corner leg 80 is further described with respect to FIGS. 9-12. FIG. 9 is a rear perspective illustration of one preferred form of the corner leg 80. FIGS. 10 and 11 are respectively an elevation and a plan view of the screed corner 80. FIG. 12 is a rear perspective illustration of another preferred form of the corner leg 80. In one form, the corner leg 80 is constructed from formed sheet metal. Sheet metal is readily workable. Generally, the weep screeds 40-8 and 40-10 as well as the remainder of the body of the screed corner 60 will also comprise sheet metal. Therefore, no galvanic reaction will be present. However, many other materials could be used.

The screed corner leg 80 comprises a corner bracket 82 which will fill the gap 80. The corner bracket 82 has upper and lower arms 84 and 85 which are preferably at the same angle to each other as the arms of the angular bead legs 66 and 67. The legs 66 and 67 intersect at a corner 86. The corner bracket 82 subtends an angle substantially equal to the angle between the first and second bead legs 66 and 67. In the form illustrated in FIG. 9, the corner 86 has an arcuate horizontal cross section. In the form illustrated in FIG. 12, the corner bracket 82 has a corner 86 which comprises perpendicular sections to provide for a square corner 81 in a horizontal plane. The upper arm 84 has tabs 91 and 92 at opposite angular sides thereof. The tabs 91 and 92 are dimensioned to be in registration with the arms 67 and 68 of the angular bead. Similarly, the lower, second arm 85 has tabs 94 and 95 extending from opposite angularly disposed ends for respectively contacting the lower arms 71 and 72.

Figure 13:
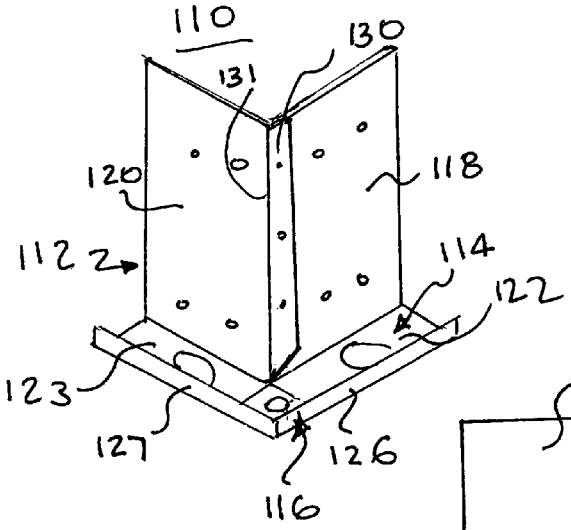
FIG. 13 is a perspective view of a further embodiment including a planar bead.

FIG. 13 is a perspective view of a further embodiment including a planar bead. A corner screed 110 is illustrated having a nailing flange 112 and a bead in the form of an arm 114. The arm 114 extends from the nailing flange 112. In many embodiments, the arm 114 may be perpendicular to the nailing flange 112 and extend horizontally. A lower flange 116 extends upwardly from the arm 114. The nailing flange 112 comprises first and second legs 118 and 120. The arm 114 has perpendicular sections 122 and 123. The lower flange 116 has perpendicular sections 126 and 127 defining a square outer corner 133 at their intersection.

Figure 14:
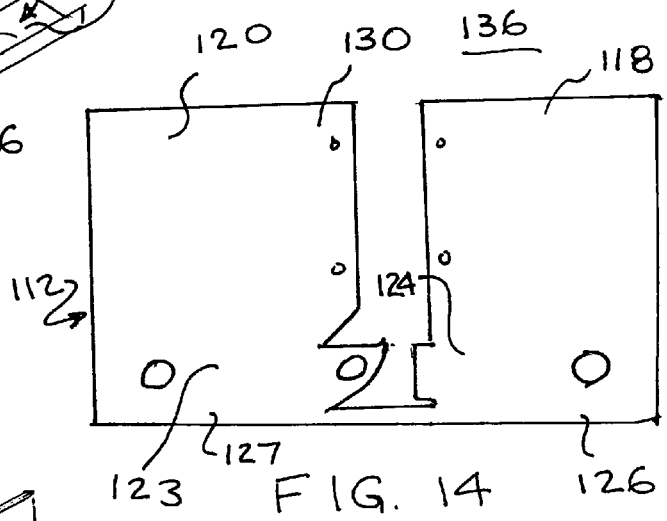
FIG. 14 is a plan view of a stamped blank form.

In the present embodiment, the legs 118 and 120 are not a continuous, single piece. The leg 120 has a tab 130 which is bent at the corner 131 to align with and contact a surface of the leg 118. The tab 130 may be spot welded to the leg 118 in order to provide for a substantially waterproof corner 131. FIG. 14 is a plan view of a stamped blank form 136. The blank form 136 may be folded to form the corner screed 110.

Figure 15:
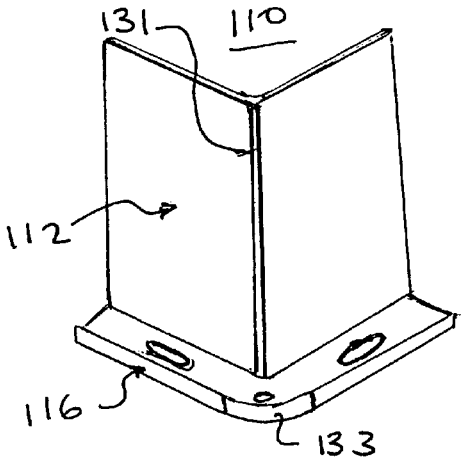
FIG. 15 is a perspective view of a further embodiment including a planar bead.

FIG. 15 is a perspective view of another embodiment including a planar bead. The same reference numerals are used to denote components corresponding to the embodiment of FIG. 13. However, in the embodiment of FIG. 15, the arm sections 122 and 123 and the lower flange sections 126 and 127 are formed to provide an arcuate outer corner 133. Contours other than a square corner or an arc could be provided in all embodiments.

Figure 17:
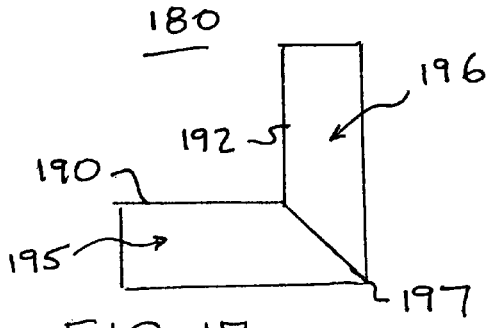
FIGS. 16, 17 and 18 are respectively a perspective view, a plan view and a partial cross-sectional view of a further form of corner screed.
Figure 16:
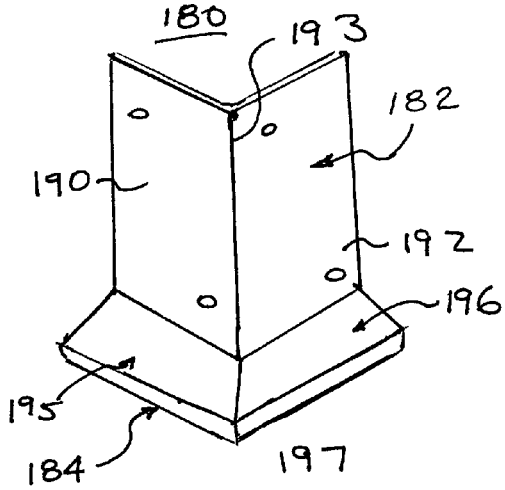
Figure 18:
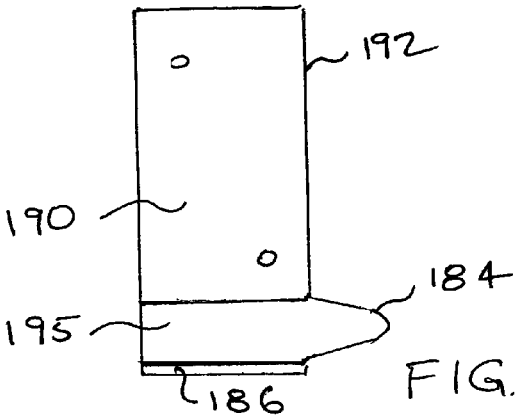

FIGS. 16, 17, and 18 are respectively a perspective view, a plan view and a partial cross-sectional view of a corner screed 180 which may be molded. One material suitable for a molded screed corner is PVC. Other materials may be used. The material should be both water resistant and should have sufficient strength to resist damage due to hammer blows. The corner screed 180 has a nailing flange 182, angle bead 184, and a lower flange 186 (FIG. 18). The nailing flange 182 has first and second legs in 190 and 192 meeting at a corner 193. The angle bead in 182 has first and second legs 195 and 196 extending away from the corner 193 and meeting at an outer corner 197. The outer corner 197 is square, but other outer corner shapes may be provided.

Figure 19:
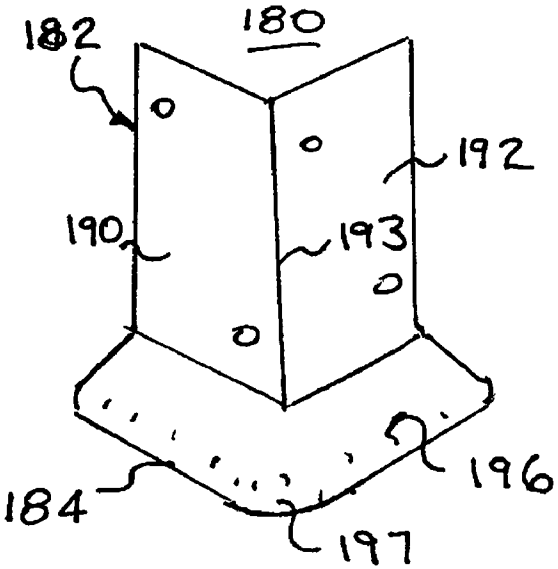
FIGS. 19, 20, and 21 are respectively a perspective view, plan view and an elevation of a corner screed which may be molded.
Figure 20:
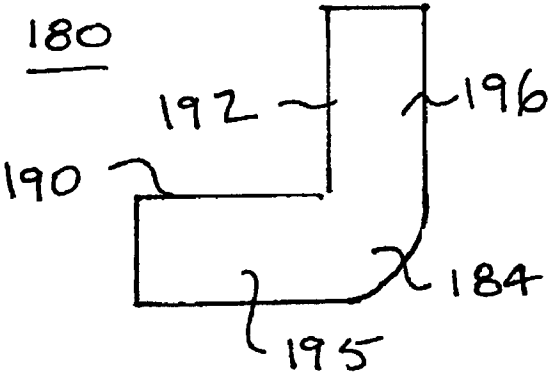
Figure 21:
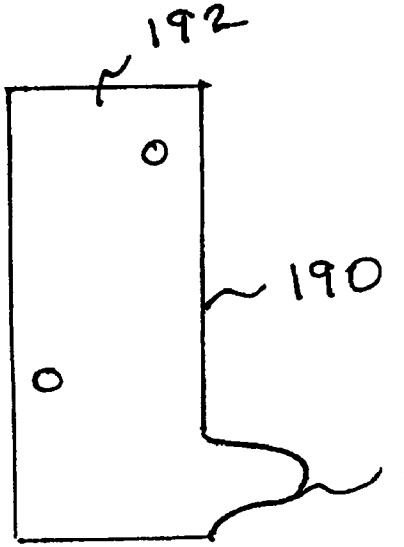

FIGS. 19, 20, and 21 are respectively a perspective view, plan view and an elevation of an alternative form of corner screed 180. The corner screed 180 is formed in a manner similar to the corner screed 180, but it has a rounded, or "radiused" outer corner 197. The same reference numerals are utilized to denote components corresponding to those in the embodiment of FIGS. 16-18.

The horizontal depth of the beads, commonly called screed depth, in nominal current embodiments is ⅞". This is a common depth of stucco applied to exterior walls in selected geographical areas. The screed depth corresponds to the depth of stucco to be applied. It is noted that regions having different climates generally tend to have sets of construction parameters adapted to that region's climate. Parameters may include depth of stucco and additional or fewer materials used under a stucco layer. On concrete or other masonry, building paper and lath are not generally used. A common screed depth in such applications is ½". Corners in accordance with embodiments of the present invention may be constructed to fit current or future screed products. In other situations, a screed depth of 1⅜" inches may be provided. This will accommodate insulation foam applied between a wall and a stucco layer.

Embodiments of the present subject matter assure that stucco depth at screed corners will be provided in accordance with building specifications. This enables provision of corners that will meet current building codes. Because the screed corner covers weep screeds, waterproofing is assured. The issue of leaking at butting corners of hand cut weep screed is avoided.

Prefabricated screed corners allow for provision of reliable construction even when installation is performed by apprentices rather than experienced journeymen. Reliability helps prevent callbacks for stucco repairs, which are costly to builders, contractors, and homeowners. Building inspection is improved since an inspector may look for the screed corners at the time the lath is inspected and then be assured of integrity of the corner after stucco is applied.

An illustrative embodiment could cost from $15 to $40 for a set of corner screeds. Labor savings will exceed the cost of the screed corners. Worker compensation costs may be decreased since installers will not be working with sharp edges on sheet metal. Injuries to homeowners due to damaged corners will also be prevented.

The previous description of some aspects is provided to enable any person skilled in the art to make or use the present subject matter. Various modifications to these aspects will be readily apparent to those skilled in the art, and the generic principles defined herein may be applied to other aspects without departing from the spirit or scope of the subject matter. For example, one or more elements can be rearranged and/or combined, or additional elements may be added. Thus, the present subject matter is not intended to be limited to the aspects shown herein but is to be accorded the widest scope consistent with the principles and novel features disclosed herein.

What is claimed is:

1. A weep screed corner comprising: a unitary member bent to form first and second nailing flanges and a bead, said nailing flanges being joined at a vertically disposed corner and being angularly displaced at an angle to be in registration with first and second adjoining walls; said bead comprising a first bead section and a second bead section extending away from said first and second nailing flanges respectively, said first and second bead sections each comprising at least one weep hole; and a discrete corner leg subtending an angle corresponding to angular displacement between said first and second nailing flanges and closing a gap and joining said first and said second bead sections.

2. A weep screed corner according to claim 1, wherein said bead comprises a shape and closing a volume outwardly extending away from said nailing flanges.

3. A weep screed corner according to claim 2, further comprising lower flanges each extending downwardly from one said bead section.

4. A weep screed corner according to claim 3, wherein each lower flange is substantially coplanar with one said nailing flange.

5. A weep screed corner according to claim 3, wherein said first and second bead sections are transversely coextensive with said first and second nailing flanges respectively, defining a gap between said first and second bead sections; and wherein said corner leg closes said gap and subtends the angle.

6. A weep screed corner according to claim 5, wherein said corner leg is positioned inwardly of said first and second bead sections and secured thereto.

7. A weep screed corner according to claim 6, wherein said corner leg further comprises tabs extending therefrom secured to said first and second bead sections.

8. A weep screed corner according to claim 7, wherein said corner leg comprises first and second portions substantially colinear with respect to said first and second bead sections respectively, said first and second bead sections meeting at a vertex.

9. A weep screed corner according to claim 8, wherein said corner leg comprises a contour connecting said first and second bead sections.

10. A weep screed corner according to claim 1, wherein said bead comprises a substantially planar member.

11. A weep screed corner according to claim 10, wherein said bead extends substantially perpendicularly from said nailing flanges.

12. A weep screed corner according to claim 11, wherein said corner leg comprises first and second portions substantially colinear with respect to said first and second bead sections respectively, said first and second bead sections meeting at a vertex.

13. A weep screed corner according to claim 11, wherein said corner leg comprises a contour connecting said first and second bead sections.

* * * * *